United States Patent [19]

Kroupa

[11] Patent Number: 4,759,691

[45] Date of Patent: Jul. 26, 1988

[54] COMPRESSED AIR DRIVEN VACUUM PUMP ASSEMBLY

[76] Inventor: Larry G. Kroupa, 2014 Eastman Ct., Arlington Heights, Ill. 60004

[21] Appl. No.: 27,883

[22] Filed: Mar. 19, 1987

[51] Int. Cl.[4] ..... F04F 5/00

[52] U.S. Cl. ..... 417/174; 417/195; 417/63

[58] Field of Search ..... 417/174, 151, 169, 195, 417/196, 198, 63

[56] References Cited

U.S. PATENT DOCUMENTS

| | | | |
|---|---|---|---|
| 465,590 | 12/1891 | Burke | 417/198 |
| 984,279 | 2/1911 | Leblanc | 417/174 X |
| 1,091,081 | 3/1914 | Renard | 417/174 |
| 1,137,767 | 5/1915 | Leblanc | 417/174 X |
| 1,195,915 | 8/1916 | Damrow | 417/151 |
| 2,070,562 | 2/1937 | Coyne et al. | 417/151 |
| 3,474,953 | 10/1969 | Duhaime et al. | 417/195 X |
| 3,959,864 | 6/1976 | Tell | 417/174 X |
| 4,395,202 | 7/1983 | Tell | 417/174 X |
| 4,400,138 | 8/1983 | Baer | 417/195 X |
| 4,402,651 | 9/1983 | Ise | 417/187 X |
| 4,466,778 | 8/1984 | Volkmann | 417/174 |
| 4,565,499 | 1/1986 | Greenberg | 417/174 |
| 4,597,716 | 7/1986 | Evenson | 417/198 X |
| 4,696,625 | 9/1987 | Greenberg | 417/174 |

OTHER PUBLICATIONS

Coppus Engineering Corp., Brochure entitled "Coppus Jectair", Dec. 1979, p. 17.

*Primary Examiner*—Carlton R. Croyle
*Assistant Examiner*—Paul F. Neils
*Attorney, Agent, or Firm*—Silverman, Cass, Singer & Winburn

[57] ABSTRACT

Compressed air driven vacuum pump assembly wherein the energy contained in compressed air is used to create a vacuum flow within a housing unit. Preferably, the modular housing unit includes a series of axially aligned air nozzles to provide a substantially straight air flow path through the housing unit. A series of axially aligned vacuum structures provide a vacuum flow path that is substantially parallel to the air flow path. The capacity of the vacuum pump is increased by elongating and enlarging the air and vacuum flow paths by means of the addition of modular housing units. The vacuum pump assembly includes an external muffler to dampen the air flow as it exits the housing unit.

14 Claims, 2 Drawing Sheets

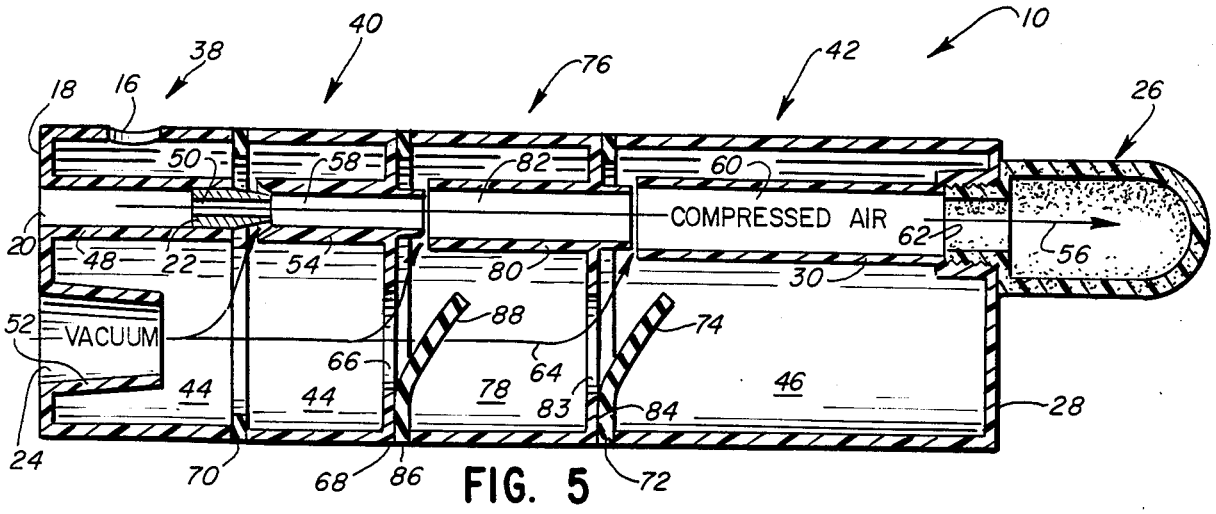
FIG. 5
FIG. 6A
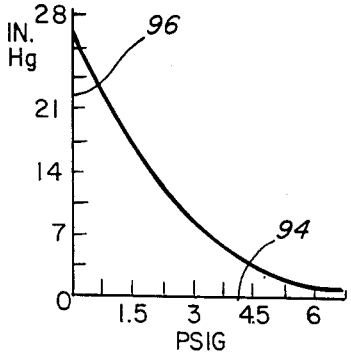
FIG. 7A
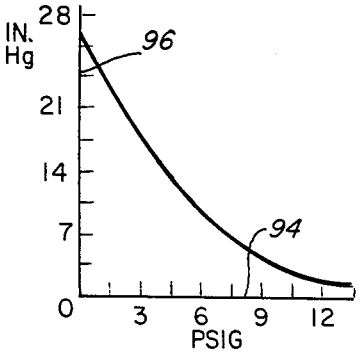
FIG. 8A
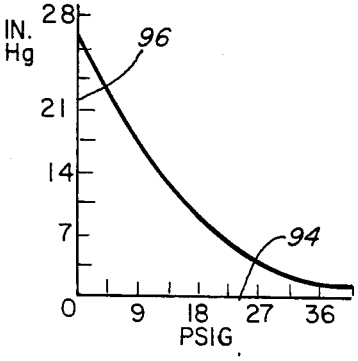
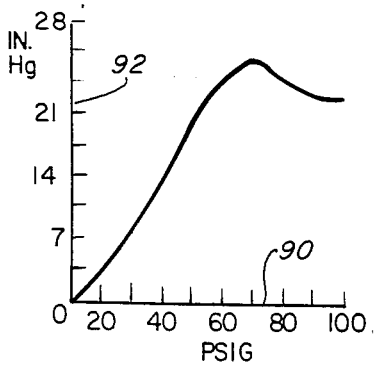
FIG. 6B
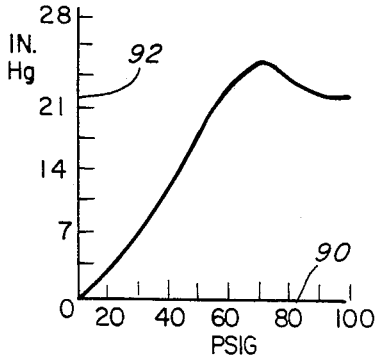
FIG. 7B
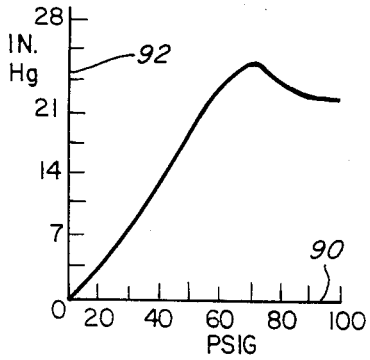
FIG. 8B

COMPRESSED AIR DRIVEN VACUUM PUMP ASSEMBLY

BACKGROUND OF THE INVENTION

The invention relates generally to a vacuum pump and more particularly to a compressed air driven vacuum pump assembly wherein a series of air nozzles are located essentially parallel to a series of vacuum passage structures to provide a vacuum pump assembly having an unusually efficient vacuum capability.

Vacuum pumps are used in a variety of applications. For example, vacuum pumps are used in manufacturing and material handling to hold an object in a particular position or to lift and transfer an object from one location to another. In the graphic art field, vacuum pumps are used to transfer paper or film from one location to another. Vacuum pumps are also used in connection with suction devices such as those utilized in medical or dental laboratories. However, many of these applications are not compatible with a conventional, electrical or combustible fuel driven vacuum pump because there is a risk of combustion or fuel leakage.

Numerous attempts have been made to use the energy contained in compressed air to create a vacuum and a secondary flow of air (vacuum flow). These prior art attempts have not been able to provide a simple, efficient, and economical vacuum pump. For example, a single venturi air nozzle has been utilized to allow compressed air to expand in one step to create a vacuum flow. However, in a single air nozzle vacuum pump, a large amount of energy is consumed without producing a correspondingly high vacuum flow. Other pumps have included a complicated arrangement of nozzles within a multi-chambered housing. In these attempts, the complexity of the air and vacuum flow paths within the vacuum pump housing severely reduces the efficiency of the pump.

The disadvantages of the prior art are overcome in accordance with the present invention by providing a simplified vacuum pump assembly that is economical to manufacture and that will efficiently extract over 90% of the energy available in the compressed air to produce a high vacuum flow. For example, the vacuum pump of the present invention will use less compressed air but deliver three or four times more vacuum flow than pumps having a single venturi air nozzle.

SUMMARY OF THE INVENTION

The present invention provides a compressed air driven vacuum pump assembly wherein compressed air is allowed to expand in controlled steps through a series of axially aligned air nozzles to create a vacuum flow within a housing unit. A series of axially aligned vacuum passage structures provide a vacuum flow path interior to a preferably modular housing unit that is substantially parallel to the air flow path through the axially aligned air nozzles. The substantially parallel air and vacuum flow paths reduce the energy loss due to friction to provide an unusually efficient vacuum pump. An external muffler is provided to dampen the air flow as it exits the housing and to reduce the noise level to a comfortable range.

BRIEF DESCRIPTION OF THE DRAWINGS

FIG. 5 is a side sectional view of the assembly of FIG. 4 illustrating the compressed air flow path and the vacuum flow path;

FIG. 6*a* is a graph illustrating a performance curve for the three modular housing section assembly illustrated in FIG. 3 depicting the relationship between the vacuum level and the vacuum flow during the operation of the assembly;

FIG. 6*b* is a graph illustrating a performance curve for the three modular housing section assembly illustrated in FIG. 3 depicting the relationship between the vacuum level and the compressed air feed pressure during the operation of the assembly;

FIG. 7*a* is a graph illustrating a performance curve for the four modular housing section assembly illustrated in FIG. 4 depicting the relationship between the vacuum level and the vacuum flow during the operation of the assembly;

FIG. 7*b* is a graph illustrating a performance curve for the four modular housing section assembly illustrated in FIG. 4 depicting the relationship between the vacuum level and the compressed air feed pressure during the operation of the assembly;

FIG. 8*a* is a graph illustrating a performance curve for an elongated four modular housing section assembly depicting the relationship between the vacuum level and the vacuum flow during the operation of the assembly; and FIG. 8*b* is a graph illustrating a performance curve for the elongated four modular housing section assembly depicting the relationship between the vacuum level and the compressed air feed pressure during the operation of the assembly.

DESCRIPTION OF THE PREFERRED EMBODIMENT

Figure 1:
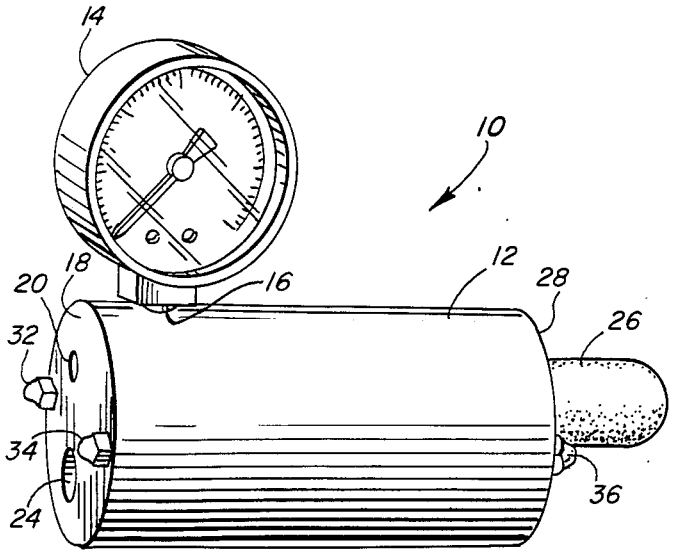
FIG. 1 is a perspective view of the vacuum pump assembly of the present invention.
Figure 2:
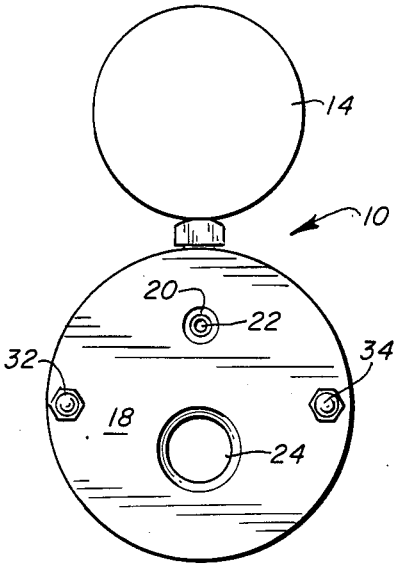
FIG. 2 is an end view of the assembly of FIG. 1.

Referring to FIGS. 1 and 2, a vacuum pump apparatus or assembly which embodies the present invention is designated generally by the reference numeral 10. The assembly 10 has a housing 12, preferably with a negative pressure gauge 14 extending through a threaded gauge port 16 in the housing 12 to communicate with the interior of the housing 12 to conveniently measure the vacuum level within the housing 12.

Figure 3:
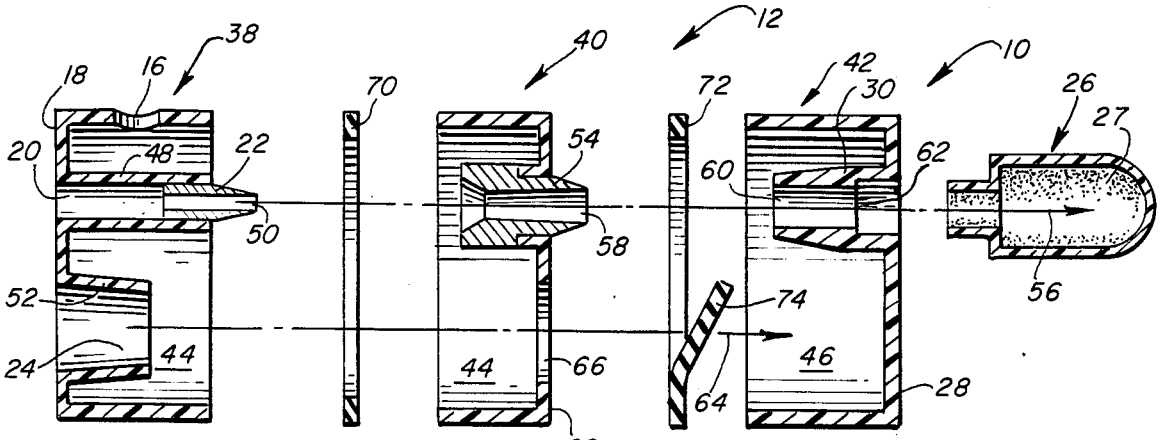
FIG. 3 is an exploded sectional view illustrating the assembly of FIG. 1 having three modular housing sections.

A first exterior wall 18 has an air inlet port 20 aligned with a high vacuum venturi nozzle 22 for the introduction of compressed air (best seen in FIGS. 2 and 3). An inlet vacuum passage 24 extends through the wall 18 such that a vacuum flow passing therethrough is substantially parallel to a compressed air flow passing through the air inlet port 20 and the nozzle 22. The substantially parallel flow paths will reduce the amount of energy lost to friction over prior art complex structures. The prior art complex flow paths require that both the compressed air and the vacuum flow paths have essentially ninety degree turns therein which cause corresponding energy losses. Therefore, a lower vacuum flow will result.

The vacuum pump assembly 10 uses the energy contained in the compressed air to create a vacuum within the housing 12 and a vacuum flow, also referred to as a free air flow or a secondary air flow, through the inlet vacuum passage 24. Since compressed air is the source of energy, the apparatus 10 is particularly well suited for applications where a potential for explosion, combustion or fuel leakage would prevent the use of a conventional electrical or fuel driven vacuum pump.

The vacuum flow through the inlet vacuum passage 24 is directly related to the compressed air flow through the nozzle 22. Therefore, the desired level of vacuum flow through the passage 24 is conveniently controlled by adjusting the inlet pressure of the compressed air through the nozzle 22 by means of a pressure valve (not shown). The vacuum flow is established quickly. There is essentially no buildup required for the assembly 10 to reach its full capacity. Likewise, the vacuum flow terminates quickly. Further, the pump assembly 10 is conveniently and rapidly cycled on and off by controlling the compressed air flow. These advantages are particularly important in a lift and transfer application where the efficiency of the operation will depend upon the rapid and efficient response of the vacuum pump.

An external muffler 26 is located on a second exterior wall 28 such that it is aligned with an exit air nozzle 30 (best seen in FIG. 3). The external muffler will dampen the flow of air exiting the housing 12 and reduce the noise level to a comfortable range for those who are sensitive to sound. The muffler 26 can be filled with or constructed from a porous filter material 27. However, it is contemplated that materials other than the porous filter material 27 can be substituted so long as the muffler 26 serves to reduce the noise level associated with the air exiting the housing 12.

The external muffler 26 is constructed to be easily removed from the housing 12. For example, the muffler 26 can be held in position by means of friction or the muffler 26 can be held in position by means of a threaded engagement. Once the muffler 26 is removed it can be checked for an accumulation of water, oil, or other matter. The muffler 26 then can be conveniently cleaned and replaced in the housing 12, or a replacement muffler can be substituted for the soiled or damaged muffler 26.

As will be discussed in connection with FIG. 3, the housing 12 preferably will have several modular sections. In that case, the modular sections are secured into a single unit by a locking structure, for example, by a plurality of tie rods (not shown) passing through the modular sections. Cap nuts, such as 32, 34, and 36, can be tightened on the threaded tie rods to secure the modular sections into a single unit.

Referring to FIG. 3, the housing 12 is illustrated having a first modular housing section 38, an intermediate modular housing section 40 and a final modular housing section 42. The sections 38, 40, and 42 are constructed to mate such that they are aligned in series to define compartments 44 and 46 therebetween, the high vacuum nozzle 22 is seated in an air inlet structure 48 such that an air inlet passage 50 provides communication between the exterior of the housing 12 and the compartment 44. An inlet vacuum structure 52 defines the inlet vacuum passage 24 to likewise provide communication between the exterior of the housing 12 and the compartment 44. Nozzles 54 and 30, seated in the modular housing sections 40 and 42, respectively, and the high vacuum nozzle 22 are axially aligned such that a compressed air flow, indicated by an arrow 56, will flow in a substantially straight path through the nozzle passages 50, 58, and 60 to exit the housing 12 through an air exit port 62 without the air flow changing direction.

A vacuum flow, indicated by an arrow 64, is maintained substantially parallel to the compressed air flow and passes from the compartment 44 to the compartment 46 through a vacuum passage structure or a port 66 located in a wall 68 of the modular housing section 40. The body gasket 70 is interposed between the modular sections 38 and 40 and the body gasket 72 is interposed between the modular housing sections 40 and 42, to provide an airtight seal therebetween. The axial flow paths of the present invention, wherein the air flow and the vacuum flow are substantially parallel to each other, will eliminate the pressure drop and resulting energy loss attributable to the complex flow paths found in prior art multiple nozzle vacuum pumps. The in line vacuum pump assembly 10 of the present invention provides a reliable operation and a significantly increased efficiency over known compressed air driven vacuum pumps.

A check valve 74, such as a one-way valve, is provided between the compartments 44 and 46 such that the vacuum pump assembly 10 is self adjusting or self regulating. For example, when a vacuum flow passes through the valve 74, the valve is in the open position. However, when the vacuum flow is substantially reduced, such as when the apparatus 10 is utilized to hold or to lift an object, the valve 74 will close to shut down the venturi effect of the nozzle 30. If the assembly 10 has a maximum vacuum level of 27 inches of mercury, it will reach that level when, at a preset compressed air flow, there is no vacuum flow. The valve 74 will then close. Since the compartment 44 always remains operational, a relatively stable vacuum level will be maintained within that compartment. The valve 74 is illustrated in FIG. 3 as a flap valve that is integral with the body gasket 72. It is contemplated, however, that other check valves can be substituted. For example, where a larger vacuum pump assembly 10 is utilized in a heavy industrial application, other valve structures such as a needle valve or a ball valve could be substituted.

Figure 4:
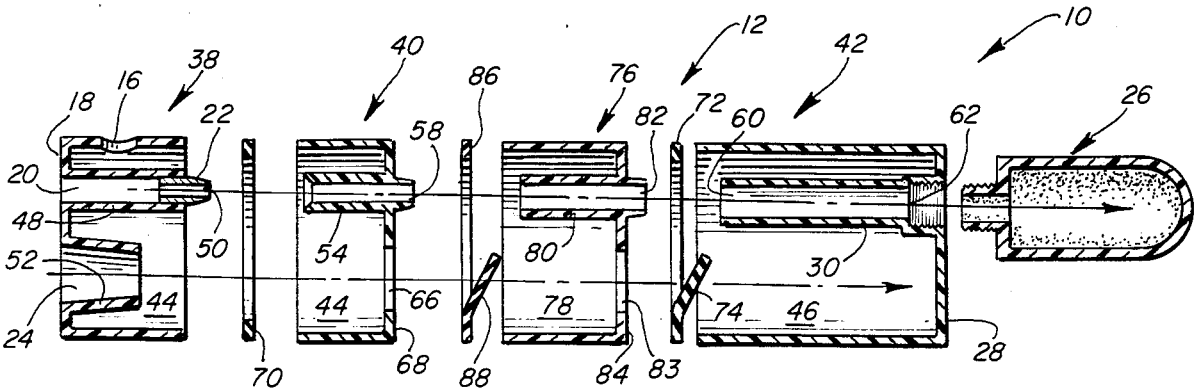
FIG. 4 is an exploded sectional view illustrating the assembly of FIG. 1 having four modular housing sections.

The capacity of the assembly 10 can be increased by the addition of one or more intermediate modular housing sections such as section 76 with enlarged nozzle passage diameters, illustrated in FIG. 4. The modular housing section 76 is constructed to mate with the housing sections 40 and 42 and is aligned in series to define a compartment 78. A nozzle 80 having a passage 82 therethrough is axially aligned with the nozzles 22, 54, and 30 such that the compressed air flow again will follow a substantially straight path through the nozzle passages 50, 58, 82, and 60 to exit the housing 12 through the exit port 62 without a change in direction. A vacuum passage structure or a port 83 in a wall 84 of the modular housing section 76 is provided to allow the substantially parallel vacuum flow to pass from the compartment 44 through the compartment 78 to the compartment 46. A gasket 86 is interposed between the housing sections 40 and 76 to provide an airtight seal therebetween. A flap valve 88 is provided to maintain the previously described self-regulating feature of the assembly 10. The capacity of the assembly 10 is, therefore, adjusted by elongating the air flow path and the vacuum flow path while keeping the relationship between the air flow and the vacuum flow substantially parallel and enlarging the area of the nozzle passages 50, 58, 82 and 60.

Referring to FIG. 5, when the assembly 10 is activated by the introduction of compressed air through the nozzle 22, the air passes through the apparatus 10, as indicated by the arrow 56, in a substantially straight flow path. The compressed air is allowed to expand in a controlled manner, in steps, as it passes through the nozzles 54, 80, and 30 such that a vacuum flow is created by a venturi effect. The nozzle 22, therefore, is a high vacuum nozzle and the nozzles 54, 80, and 30 are sized to regulate the expansion of the compressed air flow through the apparatus. The resulting vacuum flow, as indicated by the arrow 64, is seen to be substantially parallel to the compressed air flow.

The graphs illustrated in FIGS. 6*a*–8*b* demonstrate the efficient performance of the apparatus 10 of the present invention. FIGS. 6*a* and 6*b* represent the three modular housing section apparatus illustrated in FIG. 3. FIGS. 7*a*–8*b* represent the apparatus 10 with the addition of a fourth modular housing section wherein the capacity of the apparatus 10 in FIGS. 8*a* and 8*b* is greater than the capacity of the apparatus 10 in FIGS. 7*a* and 7*b*. The apparatus 10, in these examples, has an optimum inlet pressure of 68 pounds per square inch gauge (PSIG) and a maximum vacuum level of 27 inches of mercury (in Hg).

In FIGS. 6*b*, 7*b*, and 8*b* the longitudinal axis 90 is the compressed air feed pressure or inlet pressure and the normal axis 92 is the vacuum level. It can be seen that at an inlet pressure of 68 PSIG the maximum vacuum level of 27 in Hg is consistent across all three graphs.

In FIGS. 6*a*, 7*a*, and 8*a* the longitudinal axis 94 is the vacuum flow or free air flow measured in cubic feet per minute (cfm) and the normal axis 96 is the vacuum level. The measurements are recorded at a compressed air feed pressure of 68 PSIG. For a specific vacuum level the vacuum flow is increased as the capacity of the apparatus 10 is increased.

The air consumption is 2.4 cfm, 4.6 cfm, and 8.1 cfm in FIGS. 6*a*, 7*a*, and 8*a*, respectively. At each specific vacuum level, for example with a feed pressure of 68 PSIG, the resulting vacuum flow can be measured. At the same time, a portion of the compressed air is consumed. In this example, the vacuum flow at a specific vacuum level increases from FIG. 6*a* to FIG. 8*a* by a factor of 6 while the compressed air that is consumed increases from FIG. 6*a* to FIG. 8*a* by a factor of only 3.4. This comparison is a striking example of the ability of the apparatus 10 to efficiently extract the energy contained in the compressed air to create the vacuum flow.

It can be seen that the present invention is uniquely flexible. The nozzles are conveniently accessible and can be easily inspected, cleaned, or replaced. The nozzles preferably are frictionally mounted, but also can be threadedly or adhesively mounted or molded in the module walls. Further, an individual nozzle can be exchanged for a different nozzle having different performance characteristics either by exchanging the individual nozzle or by exchanging the entire modular housing section. The unique flexibility of the apparatus 10 eliminates the need to stock a different vacuum pump for every application or to replace an entire vacuum pump every time a problem arises.

The assembly 10 contains virtually no moving parts to break down, wear out, or produce unwanted heat. Since the assembly 10 has virtually no moving parts, no lubrication is necessary. Further, the assembly 10 is economical to manufacture and, since it is driven by compressed air, the apparatus 10 is economical to operate.

Modification and variations of the present invention are possible in light of the above teachings. The dimensions and types of materials are not critical to the invention. The modular sections of the housing 12 can be a polymeric material such as a thermoplastic or a metal such as aluminum. Additionally, the modular sections can be secured together by a locking structure such as tie rods or by another method such as interlocking male-female members integral with the modular housing sections. It is therefore to be understood that within the scope of the appended claims, the invention may be practiced other than is specifically described.

What is claimed and desired to be secured by letters patent of the United States is:

1. A compressed air driven modular vacuum pump assembly, comprising:

a plurality of modular sections providing a compressed air flow passage therethrough and a vacuum flow passage therein, spaced from but coupled to said air flow passage;

a first modular housing section having a first exterior wall, said exterior wall having an inlet air nozzle therethrough providing an air flow path substantially perpendicular to said wall, said exterior wall further including inlet vacuum passage means therethrough providing a vacuum path substantially perpendicular to said wall and parallel to said air flow path for providing a vacuum flow passage therethrough;

a first intermediate modular housing section adjacent said first modular housing section, said intermediate housing section having an intermediate wall, said first exterior wall and said intermediate wall defining a first compartment interior to both said first modular housing section and said second modular housing section, said intermediate wall having an air nozzle therethrough in series with said inlet air nozzle, said wall further having intermediate vacuum passage means therethrough in series with said inlet vacuum passage means for providing a vacuum flow passage through said first compartment;

a final modular housing section adjacent said intermediate housing section, said final modular housing section having a second exterior wall, said intermediate wall and said second exterior wall defining a final compartment interior to said final modular housing section, said second exterior wall having an exit air nozzle therethrough in series with said intermediate air nozzle;

said air nozzles are axially aligned to provide said air flow path through said housing unit and said vacuum passage provides a vacuum path substantially parallel to said air flow path;

locking means for securing said modular housing sections into a single housing unit; and further including at least one check valve means for preventing vacuum flow from passing from said first compartment to said final compartment, wherein said check valve is a flap valve and each of said modular housing sections include a body gasket compressed therebetween and said flap valve is integrally formed in said body gasket between said final modular housing section and said first intermediate modular housing section.

2. The vacuum pump assembly of claim 1 further having at least one additional intermediate modular housing section adjacent said first intermediate housing section, said additional intermediate housing section having a wall defining an intermediate compartment interior to said additional intermediate modular housing section, said wall having an air nozzle therethrough aligned in series with each of said air nozzles in said housing unit, said wall further having vacuum passage means therethrough aligned in series with each of said vacuum passage means in said housing unit for providing a vacuum flow through said first and intermediate compartments.

3. The vacuum pump assembly as defined in claim 1 wherein said walls are constructed and arranged such that said air nozzles can be removed and replaced.

4. The vacuum pump assembly as defined in claim 1 including an exit air dampening muffler external to said housing unit coupled to said exit air nozzle.

5. The vacuum pump assembly as defined in claim 1 wherein said locking means includes at least one tie rod passing through said modular housing sections for locking said modular housing sections into said single housing unit.

6. The vacuum pump assembly as defined in claim 1 further including a pressure gauge communicating with at least one of said compartments.

7. The vacuum pump assembly as defined in claim 1 wherein said modular housing sections are formed from thermoplastic.

8. The vacuum pump assembly as defined in claim 1 wherein said modular housing sections are formed from metal.

9. The vacuum pump assembly as defined in claim 8 wherein said modular housing sections are formed from aluminum.

10. A compressed air driven vacuum pump assembly comprising:

a housing;

a first exterior wall of said housing having an inlet air nozzle therethrough providing an air flow path substantially perpendicular to said wall, said wall further having inlet vacuum passage means therethrough providing a vacuum path substantially perpendicular to said wall and parallel to said air flow path for providing a vacuum passage therethrough;

an interior wall defining a first compartment within said housing, said interior wall having an air nozzle therethrough axially aligned with said inlet air nozzle providing an air flow path therethrough, said interior wall further having intermediate vacuum passage means therethrough axially aligned with said inlet vacuum passage means for providing a vacuum flow passage through said inlet vacuum passage means and said intermediate vacuum passage means substantially parallel to said air flow path through said air nozzles;

a second exterior wall defining a final compartment within said housing, said second exterior wall having an exit air nozzle therethrough axially aligned with said interior air nozzle; and further including at least one check valve means for preventing said vacuum flow from passing from said first compartment to said final compartment, wherein said check valve is a flap valve and each of said compartments include a body gasket compressed therebetween and said flap valve is integrally formed in said body gasket between said final compartment and said first compartment.

11. The vacuum pump assembly as defined in claim 10 further including an exit air dampening external muffler coupled to said exit air nozzle.

12. The vacuum pump assembly as defined in claim 10 wherein said walls are constructed and arranged such that said air nozzles can be removed and replaced.

13. The vacuum pump assembly as defined in claim 10 wherein said housing is comprised of a plurality of discrete modular housing sections aligned in series; and locking means for securing said plurality of modular housing sections to one another into a single housing unit.

14. The vacuum pump assembly as defined in claim 13 further including at least one intermediate modular housing section interposed between said interior wall and said second exterior wall of said housing unit, said intermediate housing section having a wall defining an intermediate compartment interior to said intermediate housing section such that said intermediate compartment is aligned in series with said first compartment, said wall having an air nozzle therethrough such that said air nozzle is axially aligned with each of said nozzles, said wall further having vacuum passage means therethrough axially aligned with said inlet vacuum passage means for providing said vacuum flow path through said vacuum passage means substantially parallel to said air flow path through said air nozzles.

* * * * *